United States Patent [19]

Inoue et al.

[11] 4,420,813

[45] Dec. 13, 1983

[54] OPERATION SEQUENCE INSTRUCTION BY SYNTHETIC SPEECH

[75] Inventors: Tomohiro Inoue, Nara; Mituhiro Saizi, Kyoto, both of Japan

[73] Assignee: Sharp Kabushiki Kaisha, Osaka, Japan

[21] Appl. No.: 189,046

[22] Filed: Sep. 22, 1980

Related U.S. Application Data

[63] Continuation of Ser. No. 10,323, Feb. 7, 1979.

[30] Foreign Application Priority Data

Feb. 8, 1978 [JP] Japan ..... 53-13761

[51] Int. Cl.[3] ..... G10L 1/00

[52] U.S. Cl. ..... 364/513; 381/51

[58] Field of Search ..... 179/1 SM, 1 SG; 364/710, 513

[56] References Cited

U.S. PATENT DOCUMENTS 3,892,919 7/1975 Ichikawa ..... 179/1 SM 3,998,045 12/1976 Lester ..... 179/1 SM 4,060,848 11/1977 Hyatt ..... 179/1 SM 4,121,051 10/1978 Place ..... 179/1 SM

OTHER PUBLICATIONS

Mozer, "Talking Board", Computer Design, Jul. 1976, pp. 46, 48.

*Primary Examiner*—Emanuel S. Kemeny

*Attorney, Agent, or Firm*—Birch, Stewart, Kolasch & Birch

[57] ABSTRACT

An electronic operation sequence instruction system is shown. This system audibly instructs an operator of an operation sequence through the use of synthetic speech. A shift register is provided for storing digital information related to operation sequence instructions. The digital information stored in the shift register is progressively applied to a synthetic speech control system, which develops synthetic speech in accordance with the digital information applied thereto. Thus, an audible set of instructions is presented to an operator.

9 Claims, 5 Drawing Figures

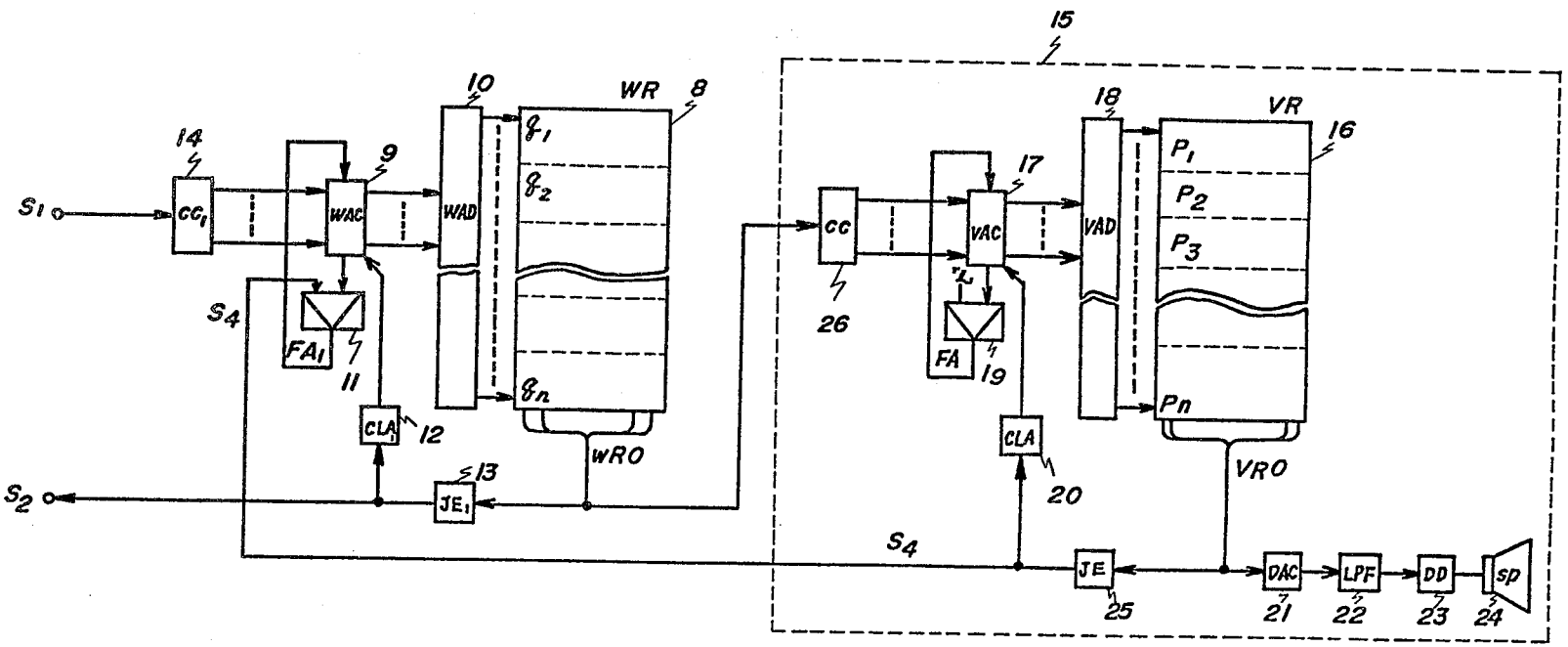
FIG.2 ( WORD SPEECH CONTROL -7-)

OPERATION SEQUENCE INSTRUCTION BY SYNTHETIC SPEECH

This application is a continuation of copending application Ser. No. 10,323, filed on Feb. 7, 1979.

BACKGROUND AND SUMMARY OF THE INVENTION

The present invention relates to an electronic instruction apparatus for instructing an operator of an operation sequence through the use of audible synthetic speech.

Conventional operation sequence instructions are presented to an operator through the use of printed matter. That is, an operation sequence is printed on paper, and the operator reads the written instructions and does operation in accordance with the instructions printed on the instruction paper. Or, numerals showing operation sequence are attached to or provided near devices to be operated, and the operator operates the devices in the order instructed by the numerals. More specifically, the conventional operation sequence instruction appeals to the operator's vision.

Accordingly, an object of the present invention is to provide a novel operation sequence instruction system.

Another object of the present invention is to provide an electronic operation sequence instruction system which provides audible instruction to the operator.

Still another object of the present invention is to provide a novel control system for a synthetic speech system for instructing the operation sequence of devices through the use of synthetic speech.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a register is provided for storing digital information related to operation sequence instructions. The digital information stored in the register is sequentially applied to a control system in response to actuation of a instruction request button. The control system controls a synthetic speech system so that the synthetic speech system develops the synthetic speech for audibly instructing the operation sequence.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 2 is a block diagram of an embodiment of a word speech control system included in the electronic operation sequence instruction system of FIG. 1;

DESCRIPTION OF THE PREFERRED EMBODIMENTS

Figure 1:
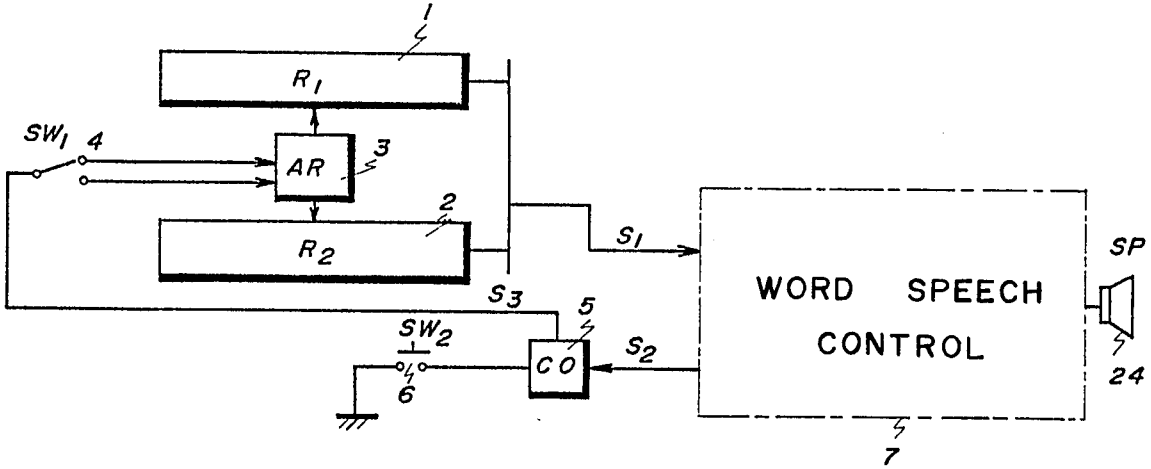
FIG. 1 is a block diagram of an embodiment of an electronic operation sequence instruction system of the present invention.

FIG. 1 shows an embodiment of an electronic operation sequence instruction system of the present invention.

The electronic operation sequence instruction system mainly comprises registers 1 and 2 for storing digital information related to operation sequence instructions. More specifically, the registers 1 and 2 store a series of code signals corresponding to words to be output through a synthetic speech system for instructing operation sequence. An access circuit 3 is associated with the registers 1 and 2 for progressively developing the code signals stored in the register 1 or 2 in a digit by digit fashion, in response to occurrence of an advance signal $S_3$. A selection switch 4 is provided for selecting the register 1 or the register 2.

The advance signal $S_3$ is developed from a control circuit 5, which is responsive to actuation of an instruction request manual switch 6. An output signal (word code signal) $S_1$ derived from the register 1 or 2 is applied to a word speech control system 7. The word speech control system 7 develops a one word speech completion signal $S_2$ to be applied to the control circuit 5 after completion of the synthetic speech of one word conducted by a speaker 24.

Now assume that the selection switch 4 is inclined to the terminal for selecting the register 1. The advance signal $S_3$ is developed from the control circuit 5 upon every actuation of the instruction request manual switch 6. In response to the thus developed advance signal $S_3$, the register 1 develops the code signal $S_1$ corresponding to a word to be spoken toward the word speech control system 7. The word speech control system 7 develops the synthetic speech corresponding to the code signal $S_1$, and then develops the one word speech completion signal $S_2$ toward the control circuit 5.

The control circuit 5 is so constructed that the advance signal $S_3$ will not be developed when the manual switch 6 is actuated before the one word speech completion signal $S_2$ is developed from the word speech control system 7, thereby preventing the occurrence of overlap of the synthetic speech. In this way, the word speech control system 7 develops the synthetic speech for instructing the operation sequence in response to the actuation of the manual switch 6 and in accordance with the code signal derived from the register 1.

FIG. 2 shows the detailed construction of the word speech control system 7.

The word speech control system 7 mainly comprises a read only memory (ROM) 8 for storing word data, an address counter 9 for addressing the ROM 8, an address decoder 10, an adder 11, and a reset circuit 12 for resetting the address counter 9. The word speech control system 7 further comprises an end code detector 13 for detecting an end code of one word stored in the ROM 8, a code converter 14, and a speech generation control circuit 15.

The ROM 8 includes data sections $q_1$ through gn, each of which stores word element codes and the end code. Output signals WRO of the ROM 8 are applied to the speech generation control circuit 15.

The address counter 9 is held at the reset state by the reset circuit 12 when the word data are not desired to be developed. Under the condition where the address counter 9 is reset, no address of the ROM 8 is selected and, hence, no word data are developed. When the word data stored in the section $q_2$ are desired to be developed, the initial address of the section $q_2$ is set in the address counter 9 through the code counter 14. The address decoder 10 develops the signal for selecting the initial address of the section $q_2$ of the ROM 8, whereby the ROM 8 develops the output signal WRO corresponding to the data stored in the initial address of the section $q_2$ of the ROM 8.

The adder 11 functions to increase the contents stored in the address counter 9 by one step. The adder 11 is not operative as long as the address counter 9 is in the reset state. After a desired initial address is set in the address counter 9 in accordance with the code signal $S_1$ derived from the register 1 or 2, the adder 11 functions to increase the contents stored in the address counter 9 by one step in response to a synthetic speech completion signal $S_4$.

In this way, the word data stored in the section $q_2$ of the ROM 8 are progressively developed toward the speech generation control circuit 15 in response to the synthetic speech completion signal $S_4$. When the entire data corresponding to the selected word have been developed from the ROM 8, the end code detector 13 detects the end code at the following step to develop the one word speech completion signal $S_2$ toward the control circuit 5 and to reset the address counter 9 through the reset circuit 12.

The speech generation control circuit 15 develops the synthetic speech in response to the output signal WRO derived from the ROM 8. The speech generation control circuit 15 mainly comprises a read only memory (ROM) 16 for storing quantized speech data, an address counter 17 for addressing the ROM 16, an address decoder 18 interposed between the address counter 17 and the ROM 16, an adder 19, and a reset circuit 20 for resetting the address counter 17.

The speech generation control circuit 15 further comprises a digital-to-analog converter 21, a low-pass filter 22, a speaker drive circuit 23, the speaker 24, an end code detector 25, and a code converter 26 connected to receive the output signal WRO derived from the ROM 8.

The ROM 16 comprises sections $P_1$ through $P_n$, each section storing the quantized speech data and the end code. More specifically, the section $P_1$ stores the quantized data of, for example, "ei", and the section $P_2$ stores the quantized data of, for example, "ae".

The address counter 17 is maintained at the reset state by the reset circuit 20 when the synthetic speech is not desired. As long as the address counter 17 is held at the reset state, no address of the ROM 16 is addressed and, hence, no synthetic speech is performed.

When the synthetic speech is desired to be conducted, an initial address of the desired section $P_i$ of the ROM 16 is set in the address counter 17 through the use of the code converter 26 in accordance with the output signal WRO of the ROM 8. The adder 19 functions to increase the contents stored in the address counter 17 by one step. When the address counter 17 is held in the reset state, the adder 19 is not operative and, hence, the reset state of the address counter 17 is maintained. After the initial address of the desired section $P_i$ is set in the address counter 17, the contents stored in the address counter 17 are automatically increased at a fixed sampling ratio through the use of the adder 19.

In this way, the quantized data stored in the selected section $P_i$ are developed from the ROM 16. An output signal VRO of the ROM 16 is applied to the D-A converter 21 and the end code detector 25. An output signal of the D-A converter 21 is applied to the speaker drive circuit 23 through the low-pass filter 22, which functions to compensate for the deterioration of the S/N ratio due to high frequency components.

When the selected synthetic sppech is completed, the ROM 16 develops the end code. The thus developed end code is detected by the end code detector 25. The detection output of the end code detector 25 is applied to the reset circuit 20 to reset the address counter 17, thereby completing the desired synthetic speech. The thus obtained reset state of the address counter 17 is maintained till the next set operation is conducted by the code converter 26. The detection output of the end code detector 25 is also applied to the adder 11 as the speech completion signal $S_4$.

In the foregoing embodiment, the ROM 8 and the ROM 16 are discrete from each other. However, the ROM 16 can be incorporated into the ROM 8.

The following is an example where the present electronic operation sequence instructor is employed in a car for instructing the operator in the checking of devices before driving the car.

The register 1 of FIG. 1 stores the following code signals corresponding to the respective devices to be checked. The code signals are stored in the register 1 in the following order.

| devices to be checked (synthetic speech) | code |
|---|---|
| (1) brake oil | 0001 |
| (2) clutch oil | 0010 |
| (3) engine oil | 0011 |
| (4) fuel indicator | 0100 |
| (5) caution lamp | 0101 |
| (6) turn signals | 0110 |
| (7) mirror | 0111 |
| (8) steering wheel | 1000 |
| (9) pedals | 1001 |
| (10) hand brake | 1010 |
| (11) lamps | 1011 |
| (12) tires | 1100 |
| (13) completion | 1101 |

The register 2 of FIG. 1 stores the following code signals in the following order.

| devices to be checked (synthetic speech) | code |
|---|---|
| (1) brake oil | 0001 |
| (2) clutch oil | 0010 |
| (3) engine oil | 0011 |
| (4) fan belt | 1110 |
| (5) cooling water | 1111 |
| (6) fuel indicator | 0100 |
| (7) caution lamp | 0101 |
| (8) turn signals | 0110 |
| (9) mirror | 0111 |
| (10) steering wheel | 1000 |
| (11) pedals | 1001 |
| (12) hand brake | 1010 |
| (13) lamps | 1011 |

-continued

| devices to be checked (synthetic speech) | code |
|---|---|
| (14) tires | 1100 |
| (15) completion | 1101 |

More specifically, the register 1 stores the instructions for checking which should be carried out before driving a car at a relatively low speed. The register 2 stores the instructions for checking which shold be carried out before driving a car above 80 Km/h.

The electronic operation sequence instruction system can be positioned at a desired section in the car. The instruction request manual switch 6 and the speaker 24 are preferably provided both on the dashboard and in the engine room.

Now assume that the selection switch 4 is inclined to the terminal associated with the register 2. When the manual switch 6 is actuated, the code signal "0001" corresponding to "brake oil" is applied from the register 2 to the code converter 14. The section $q_x$ storing the word data corresponding to "brake oil" is selected through the address counter 9 and the address decoder 10.

The data corresponding to "b" stored in the initial address of the section $q_x$ of the ROM 8 are applied to the address counter 17 through the code converter 26. Accordingly, the section $P_x$ storing the quantized data corresponding to "b" is selected to develop synthetic speech "b" through the speaker 24. After completion of the synthetic speech "b", the end code detector 25 develops the synthetic speech completion signal $S_4$ to advance the address counter 9 by one step. Therefore, the ROM 8 develops the following data corresponding to "rei" to enable the speech generation control circuit 15.

When the synthetic speech of "brake oil" is completed, the end code detector 13 develops the detection signal, which is applied to the reset circuit 12 to reset the address counter 9. The detection output of the end code detector 13 is also applied to the control circuit 5 as the one word speech completion signal $S_2$, thereby placing the system in the standby position for the following actuation of the manual switch 6.

In accordance with the synthetic speech of the "brake oil", the driver checks the oil brake. Then, the driver actuates the manual switch 6 again. In a similar manner as discussed above, the synthetic speech of "clutch oil" is conducted to instruct the checking of the clutch oil. The above-mentioned operation is repeated to the last check point "tires". The driver recognizes the completion of the checking by the synthetic speech of "completion", which follows the next actuation of the manual switch 6.

Figure 3:
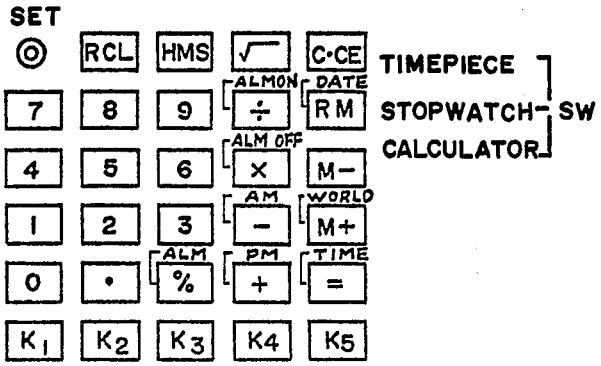
FIG. 3 is a schematic plan view of a keyboard of a combination timepiece and calculator which employs another embodiment of an electronic operation sequence instruction system of the present invention.
Figure 4:
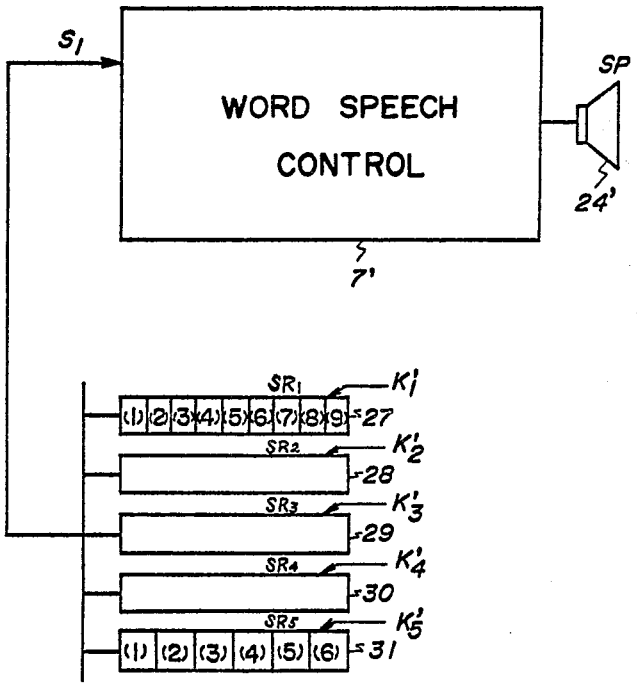
FIG. 4 is a schematic block diagram of the electronic operation sequence instruction system included in the combination timepiece and calculator of FIG. 3.

FIGS. 3 and 4 show another embodiment of the present invention, wherein an electronic operation sequence instruction system of the present invention is employed in the combination timepiece and calculator. FIG. 3 shows a keyboard of the combination timepiece and calculator, and FIG. 4 schematically shows the control system.

The keyboard includes operation instruction request keys $K_1$ for performing time information correction operation, $K_2$ for performing alarm time set operation, $K_3$ for performing current time set operation, $K_4$ for performing world clock operation, and $K_5$ for performing calendar operation. The control system includes five shift registers 27 through 31, each contents stored in the shift registers 27 through 31 being shifted left in response to shift commands $K_1'$ through $K_5'$, which are developed upon actuation of the corresponding operation instruction request keys $K_1$ through $K_5$. The control system includes a word speech control system 7', which has a similar construction as that of the word speech control system 7 of FIG. 2.

Now assume that the time information is desired to be corrected to "7:30 a.m.". The time information correction shift register 27 comprises nine sections, each section storing code signals corresponding to the following synthetic speech. The operator does the following operations in accordance with the synthetic speech instructions as set forth in Table 1.

TABLE 1

| Synthetic Speech Instructions | Operations |
|---|---|
| (1) "timepiece mode" | set the slidable switch SW at TIMEPIECE |
| (2) "a.m. or p.m.?" | depress [–] key |
| (3) "hour" | depress [7] key |
| (4) "period" | depress [·] key |
| (5) "minute" | depress [3] and [10] keys |
| (6) "second" | depress [0] and [0] keys |
| (7) "set" | depress the SET key [◯] |
| (8) "equal" | depress [=] key |
| (9) "completion" | |

The code signals stored in the sections (1) through (9) of the shift register 27 are applied to the word speech control system 7' in response to actuation of the time information correction operation instruction request key $K_1$. That is, eight step operation is instructed by the present invention operation sequence instruction system.

Now assume that the alarm time is desired to be set at "7:45. 30 a.m." The shift register 28 comprises nine sections (1) through (9), each section storing code signals corresponding to the following synthetic speech. The operator does the following operations in accordance with the synthetic speech instructions as set forth in Table 2.

TABLE 2

| Synthetic Speech Instructions | Operations |
|---|---|
| (1) "timepiece mode" | set the slidable switch SW at TIMEPIECE |
| (2) "a.m. or p.m.?" | depress [–] key |
| (3) "hour" | depress [7] key |

TABLE 2-continued

| Synthetic Speech Instructions | Operations |
|---|---|
| (4) "period" | depress [·] key |
| (5) "minute" | depress [4] and [5] keys |
| (6) "second" | depress [3] and [0] keys |
| (7) "set" | depress the SET key [◯] |
| (8) "percent" | depress [%] key |
| (9) "completion" | |

The code signals stored in the sections (1) through (9) of the shift register 28 are progressively applied to the word speech control system 7' in response to every manual actuation of the alarm time set operation instruction request key $K_2$.

Now assume that the current time information is desired to be set at "1:30. 10 p.m. of Jan. 25, 1978". The register 29 comprises seventeen sections (1) through (17), each section storing code signals corresponding to the following synthetic speech. The respective synthetic speech is conducted upon every actuation of the current time set operation instruction request key $K_3$, and the operator does the following operations in accordance with the synthetic speech instructions derived from the word speech control system 7' as set forth in Table 3.

TABLE 3

| Synthetic Speech Instructions | Operations |
|---|---|
| (1) "timepiece mode" | set the slidable switch SW at TIMEPIECE |
| (2) "time zone" | depress [4] key (select Japan) |
| (3) "set" | depress the SET key [◯] |
| (4) "M+" | depress [M+] key |
| (5) "year" | depress [1], [9], [7] and [8] keys |
| (6) "month" | depress [0] and [1] keys |
| (7) "date" | depress [2] and [5] keys |
| (8) "set" | depress the SET key [◯] |
| (9) "RM" | depress [RM] key |
| (10) "a.m. or p.m.?" | depress [+] key |
| (11) "hour" | depress [1] key |

TABLE 3-continued

| Synthetic Speech Instructions | Operations |
|---|---|
| (12) "period" | depress [·] key |
| (13) "minute" | depress [3] and [0] keys |
| (14) "second" | depress [1] and [0] keys |
| (15) "set" | depress the SET key [◯] |
| (16) "equal" | depress [=] key |
| (17) "completion" | |

Now assume that the current time in New York is desired to be displayed on a display panel (not shown) included in the combination timepiece and calculator. In this case, the world clock operation instruction request key $K_4$ is actuated. The world clock mode shift register 30 comprises three sections (1) through (3), each section storing code signals corresponding to the following synthetic speech. The operator does the following operations in accordance with the synthetic speech. In the following example, the code number applied to New York is "18".

| Synthetic Speech Instructions | Operations |
|---|---|
| (1) "time zone" | depress [1] and [8] keys (select New York) |
| (2) "M+" | depress [M+] key |
| (3) "completion" | |

Now assume that the day of the week information of January 25, 1978 is desired to be displayed on the display panel. In this case the calendar mode key $K_5$ is operated. The calendar mode shift register 31 comprises six sections (1) through (6), each section storing code signals corresponding to the following synthetic speech. The respective synthetic speech is developed upon every actuation of the calendar mode key $K_5$, and the operator does the following operations in accordance with the synthetic speech instructions derived from the word speech control system 7' as set forth in Table 4.

TABLE 4

| Synthetic Speech Instructions | Operations |
|---|---|
| (1) "timepiece mode" | set the slidable switch SW at TIMEPIECE |
| (2) "year" | depress [1], [9], [7] and [8] keys |
| (3) "month" | depress [0] and [1] keys |
| (4) "date" | depress [2] and [5] keys |
| (5) "RM" | depress [RM] key |

TABLE 4-continued

| Synthetic Speech Instructions | Operations |
|---|---|
| (6) "completion" | |

Figure 5:
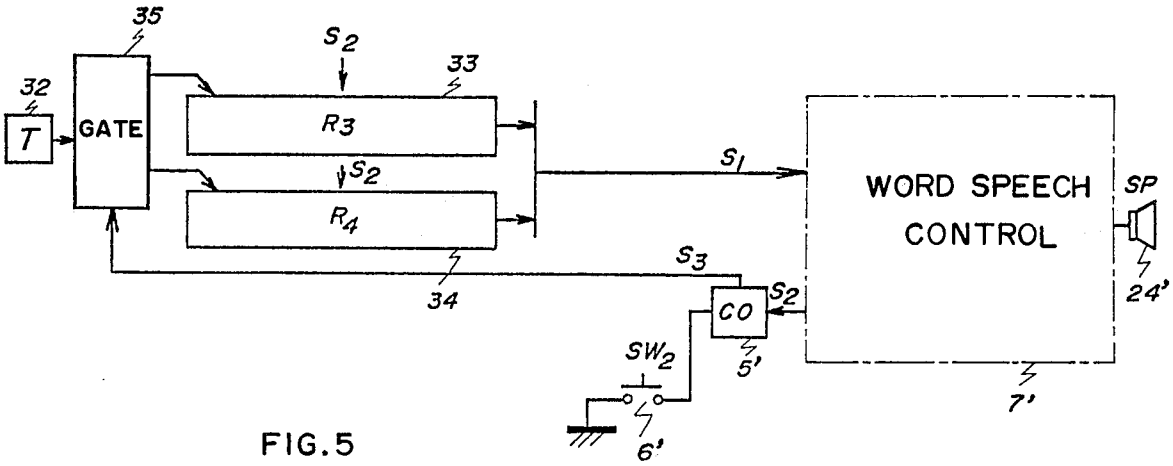
FIG. 5 is a block diagram of still another embodiment of an electronic operation sequence instruction system of the present invention.

FIG. 5 shows another embodiment of the present invention, wherein an electronic operation sequence instruction system of the present invention is employed in an electronic clock.

The instruction system of FIG. 5 mainly comprises a time information keeping circuit 32, a first and second registers 33 and 34, and a gate circuit 35. The control circuit 5', the manual switch 6' and the word speech control system 7' have the similar construction as those of the control circuit 5, the manual switch 6 and the word speech control system 7 of FIGS. 1 and 2.

The first register 33 stores digital information related to checking points which should be carried out once a day, and the second register 34 stores digital information related to checking points which should be carried out once a month. The gate circuit 35 functions to connect the control circuit 5' to the second register 34 only during a predetermined period of time in one month.

Therefore, in the normal mode, the digital information stored in the first register 33 is applied to the word speech control system 7' upon actuation of the manual switch 6' to instruct the check operation which should be carried out once a day. During the preselected period of time, which occurs once a month, the digital information stored in the second register 34 is applied to the word speech control system 7' upon actuation of the manual switch 6' to instruct the check operation which should be carried out once a month.

It will be clear from the above-discussed embodiments that the electronic operation sequence instruction system of the present invention is applicable to various apparatuses by only replacing the shift registers which store the digital information related to operation instructions, or by changing the information stored in the shift registeres.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A system for automatically instructing an operator by audibly presenting step by step instructions comprising:

first storage means for holding synthetic speech data in a plurality of locations:

second storage means for holding position data representative of the locations of said synthetic speech data, said position data being stored in a plurality of locations, each representative of an instruction;

advance means for sequentially selecting locations in said second storage means, thereby selecting instructions to be audibly reproduced in a step by step fashion;

selection means for recalling synthetic speech data from said first storage means in correspondence to the position data produced by said second storage means;

synthetic speech generation means for producing an audible instruction derived from said synthetic speech data, said instruction corresponding to the data present in the location of said second storage means selected by said advance means; and an instruction request switch generating an instruction sequence signal when actuated;

instruction completion indication means for producing a completion signal representative of the completed generation of an audible instruction by said synthetic speech generation means;

said advance means in sequence selecting the next location in said second storage means corresponding to the next instruction to be generated upon receipt of the signal produced by said instruction request switch, said advance means inhibiting the selection of the next location in said second storage means until receipt of the completion signal produced by said instruction completion indicator means.

2. The system of claim 1, wherein said first and second storage means comprise read only memories.

3. The system of claim 2, wherein said selection means comprise:

a code converter for converting said position data derived from said first storage means into a code signal;

an address counter for selecting a desired location of said read only memory in accordance with said code signal derived from said code converter; and means for automatically incrementing the contents stored in said address counter.

4. The system of claim 1 wherein said synthetic speech generation means comprises:

a digital to analog converter converting said synthetic speech data into an audio signal;

a low pass filter filtering high frequency noise out of said audio signal; and a speaker system converting said audio signal into audio waves.

5. The system of any of claims 2, 3, 1 or 4, wherein said advance means includes a plurality of shift registers, each shift register storing digital information related to a different sequence of instructions in a separate section of said second storage means, and a selector switch to select the desired one of said plurality of shift registers, thereby selecting a desired set of step by step instructions.

6. The system of claim 5 wherein said advance means further includes shift means responsive to said instruction request switch for sequentially shifting the information stored in said shift registers to thereby develop information corresponding to step by step instructions.

7. The system of claims 1 wherein said step by step instructions correspond to an automobile pre-operation checklist.

8. The systems of claims 1 wherein said step by step instructions inform an operator of a programming sequence of an electronic timepiece.

9. The system of claim 6, wherein said shift means function to shift the contents stored in said shift register by one step upon every actuation of said instruction sequence.

* * * * *